US005730497A

United States Patent [19]

Raymond et al.

[11] Patent Number: 5,730,497

[45] Date of Patent: Mar. 24, 1998

[54] MEDICAL TREATMENT TABLE

[75] Inventors: Daryl Beach Raymond, Osaka; Masato Miyahara, Kyoto, both of Japan

[73] Assignee: J. Morita Manufacturing Corporation, Kyoto, Japan

[21] Appl. No.: 799,447

[22] Filed: Feb. 13, 1997

[30] Foreign Application Priority Data

Feb. 19, 1996 [JP] Japan ..... 8-030482

[51] Int. Cl.[6] ..... A47C 1/10

[52] U.S. Cl. ..... 297/408; 297/452.34

[58] Field of Search ..... 297/408, 409, 297/391, 217.1, 452.29, 452.33, 452.34, 452.35, 452.36; 5/3, 622

[56] References Cited

U.S. PATENT DOCUMENTS

| | | | |
|---|---|---|---|
| 3,259,430 | 7/1966 | Beach | 297/217.1 X |
| 4,311,461 | 1/1982 | Hotta et al. | 297/188.04 X |
| 4,413,858 | 11/1983 | Beach | 297/391 X |
| 4,415,203 | 11/1983 | Cawley | 297/391 |
| 4,863,218 | 9/1989 | McCrackin | 297/409 X |

FOREIGN PATENT DOCUMENTS

| | | | |
|---|---|---|---|
| 3048688 | 9/1981 | Germany | 297/409 |
| 7-275302 | 10/1995 | Japan . | |

*Primary Examiner*—Milton Nelson, Jr.
*Attorney, Agent, or Firm*—Koda and Androlia

[57] ABSTRACT

Even when a headrest is moved, the hair of the patient is supported and the hair is surely prevented from hanging down.

In a treating seat which can be lifted and lowered by a lifting device, stretched portions which are raised obliquely upwardly from shoulder supporting portions which support the shoulders of the patient are integrally formed. A recess into which a headrest for supporting the head of the patient is fitted is formed between the stretched portions. The side portions of the headrest are pivotally supported on opposing portions by pins, and supported by an engaging device in such a manner that the headrest can be angularly displaced. The stretched portions support the hair and prevent the hair from hanging down.

4 Claims, 7 Drawing Sheets

MEDICAL TREATMENT TABLE

BACKGROUND OF THE INVENTION

1. Field of the Invention

The present invention relates to a treatment table which is used in dentistry, otorhinology, ophthalmology, or the like, and particularly to a medical treatment table which can prevent the hair of the patient who lies thereon face up from being wound on a rotating part of a headrest or hanging down onto the knees or the hands of the operator, or medical equipment.

2. Description of the Related Art

A typical example of the prior art is proposed by the applicant of the present application and disclosed in Japanese Patent Publication (Kokai) No. HEI7-275302. In a dental treatment table disclosed in the publication, in order to prevent the hair of the patient from hanging through a gap between a backrest for supporting the back of the patient and a headrest for supporting the head of the patient, a hair supporting cover is disposed so as to elongate between the headrest and the backrest. The hair supporting cover comprises a cover body which covers the surface of the headrest and a part of the backrest, and a bag-like engaging part or a hook-and-loop fastener which is engaged with the back of the headrest so as to prevent the cover body from being displaced or turned up. The hair supporting cover prevents the hair of the patient from making contact with medical equipment or the hands of the operator, thereby preventing such equipment or the hands from being contaminated.

In such prior art, when the headrest is moved so as to fit it with the position of the head of the patient, the bag-like engaging part or the hook-and-loop fastener is often disengaged from the headrest. When the headrest is largely angular-displaced, the hair supporting cover is wrinkled and the hair of the patient may be caught by a wrinkle.

SUMMARY OF THE INVENTION

It is an object of the invention to provide a medical treatment table in which, even when a headrest is moved, a hair supporting cover is prevented from being moved or disengaged and can be securely supported without catching the hair of the patient.

In the medical treatment table according to a first aspect of the is, a headrest for supporting a head of the patient is disposed on a backrest for supporting a back of the patient so as to be tiltable with respect to the backrest, and stretched portions are formed on the backrest, the stretched portions elongating obliquely upwardly from shoulder supporting portions which support shoulders of the patient, toward both sides of the headrest, respectively.

According to the invention, since the stretched portions are formed on the shoulder supporting portions of the backrest, the gap formed between the headrest and the backrest is reduced in size. The stretched portions support the hair of the patient, and, even when the headrest is angularly displaced, prevent the hair from hanging to be caught by a wrinkle or wound on, for example, a rotating part of the headrest. This prevents the hair of the patient from making contact with medical equipment or the hands and knees of the operator. The sides of the head of the patient are covered by the stretched portions and/or the sides of the headrest so that the visual ranges toward the sides of the patient are restricted, with the result that the patient is prevented from seeing medical equipment and the like. Therefore, fear of the patient can be lessened. Since the stretched portions are formed so as to elongate obliquely upward, the shoulders of the patient are prevented from unwantedly moving toward the headrest, thereby allowing the patient to lie face upward at a position which is suitable for treatment. This can eliminate the trouble of guiding the patient to a predetermined position during treatment. The patient's space in which the head of the patient is disposed is separated from the operator's space in which medical equipment is disposed, by the stretched portions and the side portions of the headrest, thereby ensuring a working space for the operator at the sides of and below the head of the patient. As a result, preparation and operation of medical equipment and the like can be smoothly conducted without catching visual attention of the patient.

Unlike the prior art using a hair supporting cover, displacement or turning-up of the hair supporting cover does not occur, and movement of the headrest does not cause the hair to be caught by a wrinkle. Since the stretched portions are formed integrally with the shoulder supporting portions of the backrest, the table looks neat and its appearance is improved.

In a second aspect of the invention, both sides of the headrest are obliquely upwardly raised to sandwich a recess formed by the respective stretched portions, into which the headrest is fitted, and are pivotally supported by opposing portions of the stretched portions which are adjacent to the respective sides.

According to the invention, the stretched portions are formed so as to be obliquely raised, and hence the shoulders of the patient are prevented from unwantedly moving toward the headrest, thereby allowing the patient to lie face upward at a position which is suitable for treatment. This can eliminate the trouble of guiding the patient to a predetermined position during treatment. Since the sides of the headrest are pivotally supported by the opposing portions of the stretched portions, the sides of the head of the patient are covered by the stretched portions and/or the sides of the headrest so that the visual ranges toward the sides of the patient are restricted. This prevents the patient from seeing medical equipment and the like and hence fear of the patient can be lessened. The patient's space in which the head of the patient is disposed is separated from the operator's space in which medical equipment is disposed, by the stretched portions and the side portions of the headrest, thereby ensuring a working space for the operator at the sides of and below the head of the patient. As a result, preparation and operation of medical equipment and the like can be smoothly conducted without catching visual attention of the patient.

In a third aspect of the invention, an instrument is held below the stretched portions.

According to the invention, since an instrument is held below the stretched portions, the instrument is held in a working space for the operator which is ensured below the stretched portions. Therefore, the operator can smoothly prepare and operate the instrument without catching visual attention of the patient.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
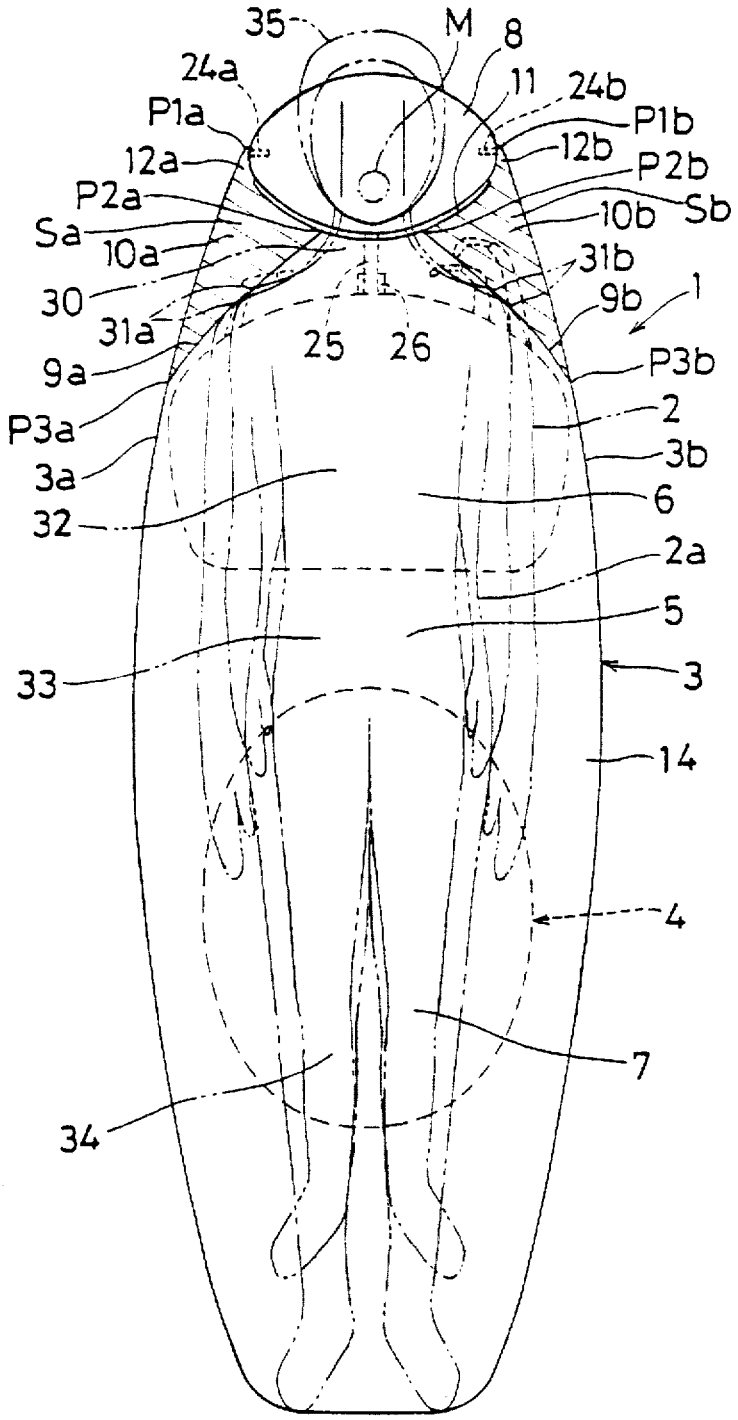
FIG. 1 is a plan view showing a dental treatment table 1 which is an embodiment of the invention.

Now referring to the drawings, preferred embodiments of the invention are described below.

Figure 2:
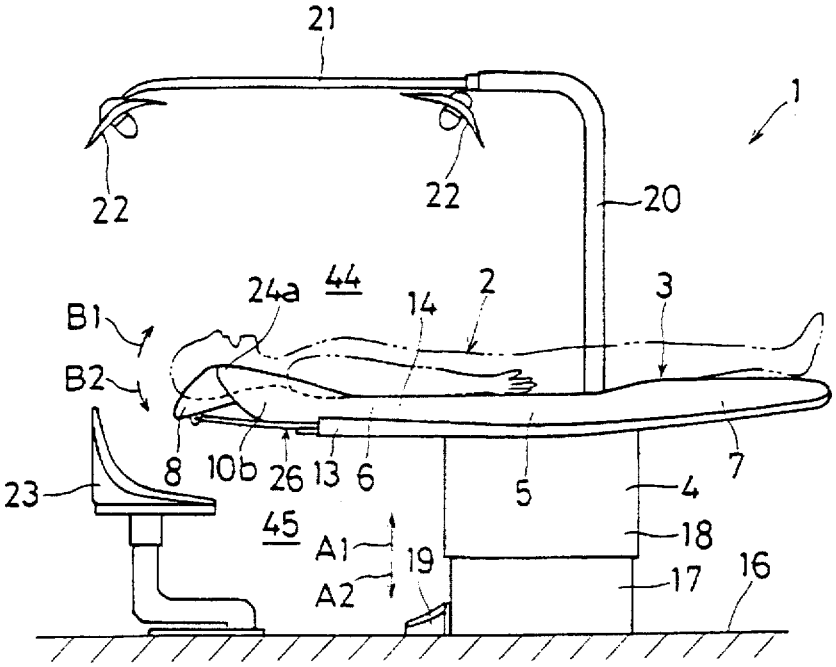
FIG. 2 is a side view showing the dental treatment table 1.
Figure 3:
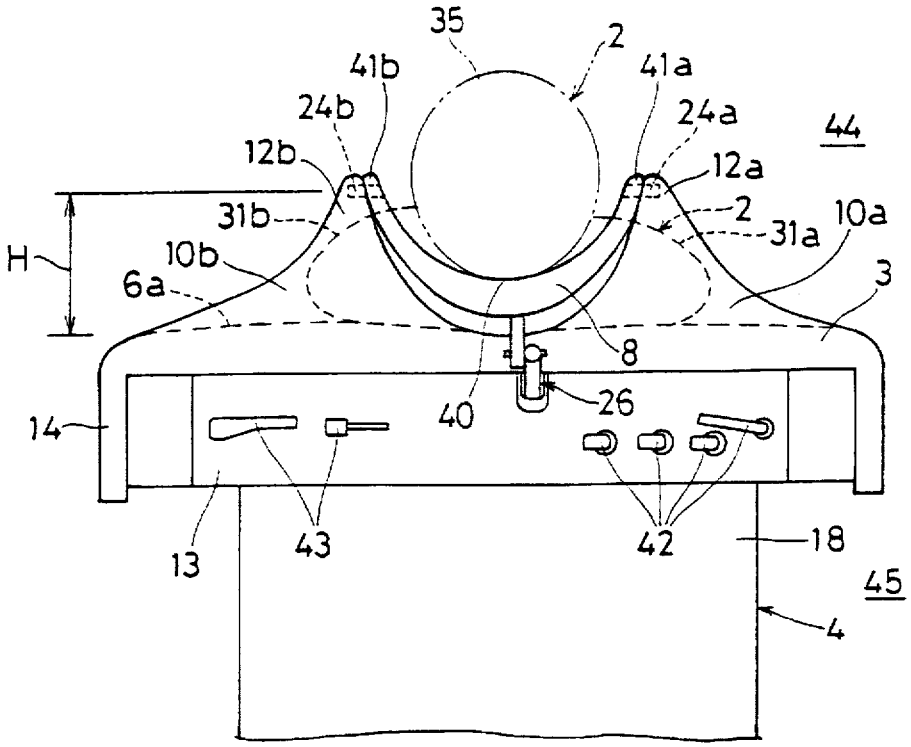
FIG. 3 is a front view showing the dental treatment table 1.

FIG. 1 is a plan view showing a dental treatment table 1 which is an embodiment of the invention, FIG. 2 is a side view showing the dental treatment table 1, and FIG. 3 is a Front view showing the dental treatment table 1 as seen From the top side in FIG. 1. The dental treatment table 1 which is a medical treatment table basically comprises a treating seat 3 which supports the patient 2 and is substantially horizontally disposed, and lifting means 4 which lifts and lowers the treating seat 3. The treating seat 3 comprises a seat body 14, and a bed body 15 which is disposed under the seat body 14. In the seat body 14, a seat plate portion 5 which supports the waist 34 of the patient 2, a backrest portion 6 which is a backrest for supporting the back 32 of the patient, and a footrest 7 which supports the legs 34 of the patient 2 are integrally formed and substantially horizontally disposed. A headrest 8 which supports the head 35 of the patient is disposed on the backrest portion 6 of the treating seat 3 so as to be tiltable with respect to the backrest portion 6. Stretched portions 10*a* and 10*b* are formed on the backrest portion 6. The stretched portions elongate obliquely upwardly from shoulder supporting portions 9*a* and 9*b* which support the shoulders 31*a* and 31*b* of the patient 2, respectively toward both sides of the headrest 8. A recess 11 into which the headrest 8 is fitted is formed between the stretched portions 10*a* and 10*b*. The headrest 8 is pivotally supported so as to be rotatable about a horizontal axis, by adjacent opposing portions 12*a* and 12*b* which sandwich the recess 11.

The lifting means 4 comprises a pedestal 17 which is mounted on a floor 16 of a treatment room, and a lifting unit 18 which is vertically moved by lift driving means (not shown) disposed in the pedestal 17. The bed body 13 of the treating seat 3 is fixed to the lifting unit 18. The pedestal 17 is provided with a foot switch 19. The lifting unit 18 is moved up and down by operating the foot switch 19, so that the treating seat 3 is vertically moved in the vertical directions indicated by the arrows A1 and A2.

The dental treatment table 1 has a post 20 which stands on a side of the treating seat 3. Two dental lamps 22 for illumination are attached to an arm 21 which elongates from the end of the post 20. A chair 23 for treatment on which the operator sits is disposed in the vicinity of the headrest 8 so as to be movable on the floor 16. Instruments 42 For the operator, and instruments 43 for an assistant are mounted on the bed body 13 and in the vicinity of the shoulder supporting portions 9*a* and 9*b*, in such a manner that they can be drawn out from the bed body. The operator instruments 42 include a 3-way syringe, an air-turbine handpiece, and a micromotor handpiece, and the assistance instruments 43 include a 3-way syringe and a vacuum syringe. When the treatment table is to be used, the operator and the assistant cause the patient 2 to lie face upward on the treating seat 3 by using the medical equipment such as the operator instruments 42 and the assistance instruments 43. While sitting on the chair for treatment, the operator treats the patient 2.

The headrest 8 has a plate-like shape which is curved in a semicircular manner. The sides of the headrest are pivotally supported by the opposing portions 12*a* and 12*b* via pins 24*a* and 24*b*, respectively. The headrest 8 is connected to the bed body 13 by engaging means 26 in such a manner that the headrest can be angularly displaced about the horizontal axis connecting the pins 24*a* and 24*b*, in the directions indicated by the arrows B1 and B2 in FIG. 2.

The stretched portion 10*a* disposed on the right side of the patient 2 is formed so as to comprise at least a substantially triangle area Sa which is hatched in FIG. 1. The area is formed by connecting the point P1*a* at which the pin 24*a* is disposed, the point P2*a* corresponding to the position which is vertically below the right side portion of the neck 30 of the patient 2, and the point P3*a* to each other. The point P3*a* is determined in the following manner. The line connecting points which are vertically below the shoulders 31*a* of patients 2 and 2*a* of different physiques, such as an adult patient 2 and a child patient 2*a* in a state where both patients 2 and 2*a* lie with their mouths located at the same position is laterally extended. The point where the extended line intersects the right side face 3*a* of the treating seat 3 is set as the point P3*a*. The stretched portion 10*b* which is formed on the left side of the patient 2, and is symmetric with stretched portion 10*a*. Therefore, the stretched portion 10*b* is designated by attaching a suffix "b" in place of the suffix "a," and its description is omitted. In the present embodiment, the stretched portions 10*a* and 10*b* are continuous to each other and integrally formed with the seat body 14.

The distance between the points P1*a* and P1*b* is selected so as to be nearly equal to that between the sides of the headrest 8, and that between the points P2*a* and P2*b* is selected so as to be nearly equal to the width of the neck of the patient 2. The recess 11 which is defined by the stretched portions 10*a* and 10*b* is formed into a semicircular shape. When the headrest 8 is mounted so as to be fitted into the recess 11, a large gap is not formed between the backrest portion 6 and the headrest 8. The formation of the stretched portions 10*a* and 10*b* allows the hair of the patient 2 to be guided to the back and the sides of the patient when the patient 2 lies face upward on the treating seat 3, thereby preventing the hair from hanging down.

The pins 24*a* and 24*b* are located at positions which are distanced upward from the upper face 6*a* of the backrest portion 6 by a height H (for example, H=about 70 to 100 mm). A contact portion 40 of the headrest 8 with which the head 35 of the patient 2 makes contact is located lower than the pins 24*a* and 24*b*. According to this configuration, the head 35 of the patient 2 can be supported without requesting the patient to take an uncomfortable posture. The stretched portions 10*a* and 10*b* having the opposing portions 12*a* and 12*b* to which the pins 24*a* and 24*b* are fixed are obliquely raised from the backrest portion 6. The range of vision of the patient 2 is blocked by the stretched portions 10*a* and 10*b* and side portions 41*a* and 41*b* of the headrest 8. This prevents the patient from seeing the various kinds of instruments 42 and 43, with the result that these instruments do not produce a sensation of fear in the patient.

Figure 4:
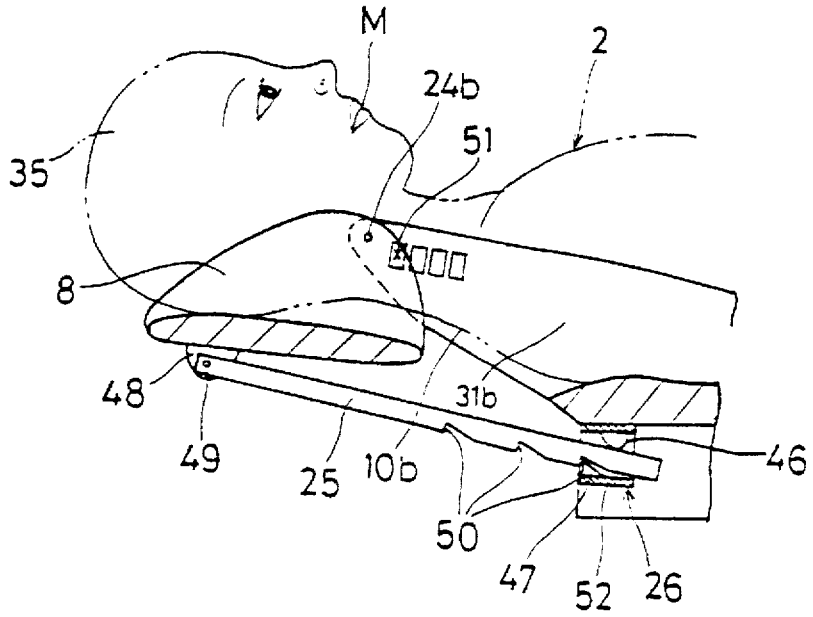
FIG. 4 is a section view showing the concrete configuration of engaging means 26.
Figure 5:
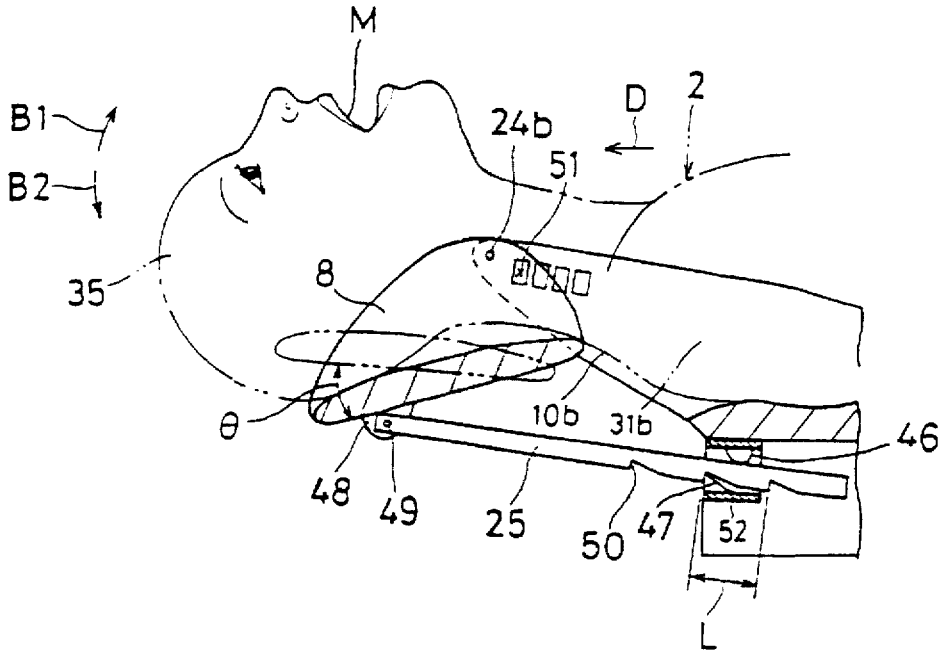
FIG. 5 is a section view showing a state in which a headrest 8 is angularly displaced from the state shown in FIG. 4.

The patient's space 44 in which the head 35 of the patient 2 is disposed is separated from the operator's space 45 in which the operator instruments 42 and the assistance instruments 43 are disposed, by the stretched portions 10*a* and 10*b* and the headrest 8. This prevents the hair of the patient from hanging into the operator's space 45. As a result, the operator instruments 42, the assistance instruments 43, and the hands of the operator and the assistant are prevented from being contaminated, and the hair of the patient is prevented from making contact with the hands and knees of the operator sitting on the treatment chair 23. As described above, the range of vision of the patient 2 is restricted and the working space for the operator can be ensured. Preparation and operation of the operator instruments 42 and the like can be smoothly conducted without catching visual attention of the patient FIG. 4 is a section view showing the concrete configuration of the engaging means 26, and FIG. 5 is a section view showing a state in which the headrest 8 is tilted so as to be angularly displaced from the state shown in FIG. 4. The engaging means 26 comprises: a substantially annular casing 52 fixed to the lower face of the seat body 14 on the side of the headrest 8; a spring 46 and an engaging claw 47 which are disposed in the casing 52 and oppose each other; and a support rod 25 which is inserted into the casing 52. The one end of the support rod 25 in that longitudinal direction is pivotally connected by a support shaft 49 to a bracket 48 which is disposed on the lower face of the one side (the left side in FIG. 4) of the headrest 8. A plurality of engaging grooves 50 are formed in the vicinity of the other end in that longitudinal direction so as to be arranged with intervals in the longitudinal direction. The other end of the support rod 25 in the longitudinal direction is inserted into the casing 52 so as to be pressingly held between the spring 46 and the engaging claw 47. The support rod is held under the state where the engaging claw 47 is selectively fitted into one of the engaging grooves 50, thereby fixedly supporting the support rod. As a result, the headrest 8 can be fixed under the state where it can be angularly displaced about the horizontal axis connecting the pins 24*a* and 24*b*.

The headrest 8 can be angularly displaced so that the head 35 of the patient 2 is tilted in the direction of the arrow B2, by changing the state of FIG. 4 to that of FIG. 5 or changing the engaging groove 50 into which the engaging claw 47 is fitted, to another one. The intervals L of the engaging grooves 50 correspond to the angular-displacement angle of the headrest 8. Therefore, the angular-displacement angle of the headrest 8 can be selected by selecting the engaging groove 50 into which the engaging claw 47 is to be fitted.

When the head of the patient 2 is tilted in the direction of the arrow B2 in this way, the head 35 of the patient 2 is moved about the fourth vertebrae cervicale 51 of the patient so as to be angularly displaced. Although the tip of the head 35 of the patient 2 is only moved by a short distance, it is possible to open the mouth M of the patient 2. Furthermore, the shoulders 31*a* and 31*b* of the patient 2 abut against the stretched portions 10*a* and 10*b* which elongate obliquely upward, and hence the shoulders are prevented from being displaced toward the head 35 of the patient 2 as indicated by the arrow D. Therefore, the position of the mouth M of the patient 2 is not largely moved by the angular-displacement of the headrest 8, with the result that the operator can smoothly conduct the treatment.

Depending on the physique of the patient, the third vertebrae cervicale may function as the angular-displacement center of the operation of tilting the head 35.

The seat body 14 is covered by a sheet made of polyethylene or vinyl chloride which has chemical resistance and water repellency. According to this configuration, the seat body is prevented from being deteriorated by chemical agents, and, when a chemical agent or water spills on the seat body, such an agent or water can be easily removed away by wiping. An antibacterial coating may be applied to the seat body 14. This suppresses propagation of various bacteria, so that the treatment table can be easily maintained and suitably used as a dental treatment table.

Figure 6:
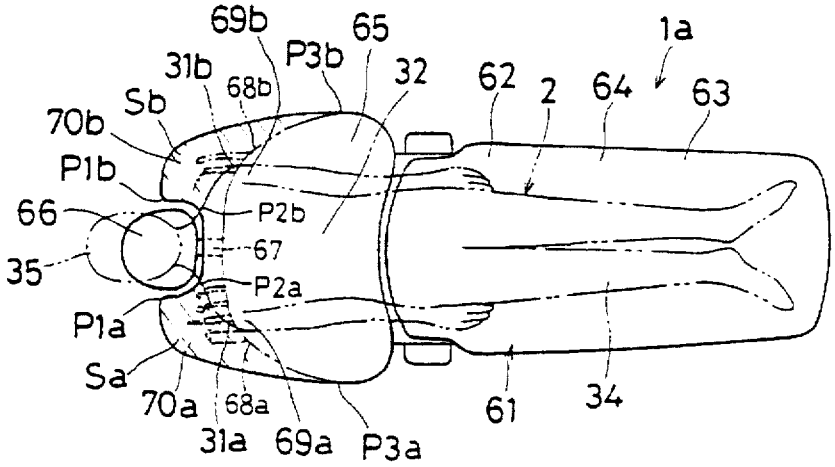
FIG. 6 is a plan view showing a dental treatment table 1*a* which is another embodiment of the invention.
Figure 7:
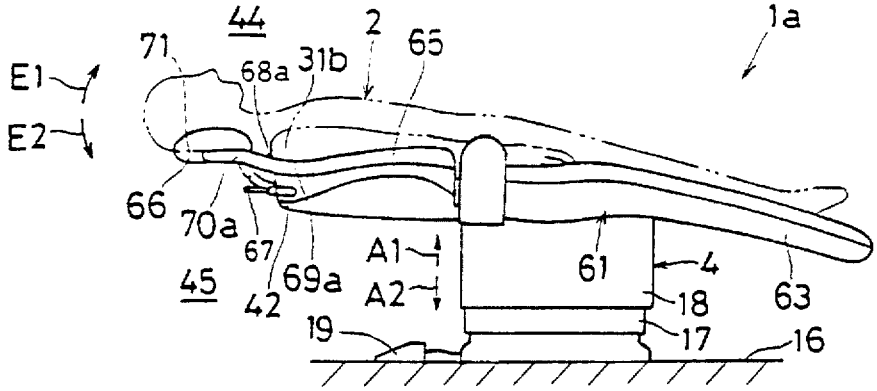
FIG. 7 is a side view of the dental treatment table 1*a;*
Figure 8:
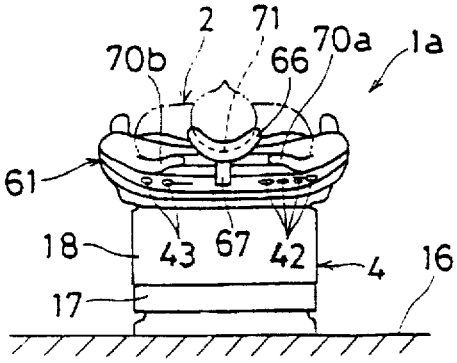
FIG. 8 is a front view of the dental treatment table 1*a;*

FIG. 6 is a plan view showing a dental treatment table 1*a* which is another embodiment of the invention, FIG. 7 is a side view of the dental treatment table 1*a* shown in FIG. 6, and FIG. 8 is a front view of the dental treatment table 1*a* as seen from the left side in FIG. 7. The components configured in the same manner as those of the embodiment shown in FIGS. 1 to 5 are designated by the same reference numerals and their description is often omitted. The dental treatment table 1*a* of the embodiment comprises lifting means 4 which is mounted on a floor 16 of a treatment room or the like, and a treating seat 61 which is lifted and lowered in the directions of the arrows A1 and A2 by the lifting means 4. The treating seat 61 comprises: a seat unit 64 which is substantially horizontally disposed and in which a seat plate portion 62 on which the patient 2 sits, and a footrest portion 63 which supports the legs 34 of the patient 2 are integrally formed; and a backrest 65 which is mounted on the seat unit 64 so as to be tiltable in the directions of the arrows E1 and E2 and which supports the back 32 of the patient 2.

In the backrest 65, a headrest 66 is engagingly fixed at a desired tilted position by engaging means 67, and shoulder supporting portions 68*a* and 68*b* which support the shoulders 31*a* and 31*b* of the patient 2 are formed. In the shoulder supporting portions 68*a* and 68*b*, formed are recesses 69*a* and 69*b* into which the shoulders 31*a* and 31*b* of the patient are partially fitted and which are gently curved. In the backrest 65, stretched portions 70*a* and 70*b* are continuous to the shoulder supporting portions 68*a* and 68*b* in which the recesses 69*a* and 69*b* of the backrest 65 are formed, respectively. In the same manner as the embodiment of FIGS. 1 to 5, the stretched portions 70*a* and 70*b* elongate toward the headrest 66 in ranges including areas Sa and Sb enclosed by at least points P1*a*, P2*a*, and P3*a*, and P1*b*, P2*b*, and P3*b*, and are formed at a position which is lower than or substantially equal in height to a contact portion 71 of the headrest 66 which supports the head 35. According to this configuration, the ranges of vision of the patient 2 toward the sides are not blocked so that the patient is prevented from feeling an oppressive sensation. Furthermore, the ranges of vision of the patient 2 in obliquely downward directions are blocked by the stretched portions 70*a* and 70*b*, and hence the patient is prevented from seeing the various kinds of instruments 42 and 43, with the result that these instruments do not cause fear to the patient 2. As described above, the formation of the stretched portions 70*a* and 70*b* can prevent the hair of the patient from hanging into the operator's space, without producing sensations of fear and oppression in the patient.

Figure 9:
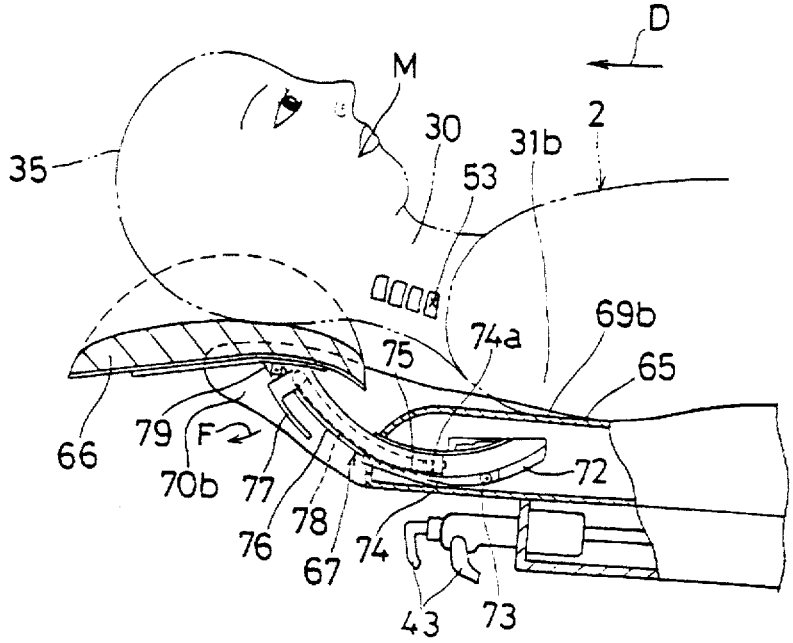
FIG. 9 is a section view showing the concrete configuration of engaging means 67.
Figure 10:
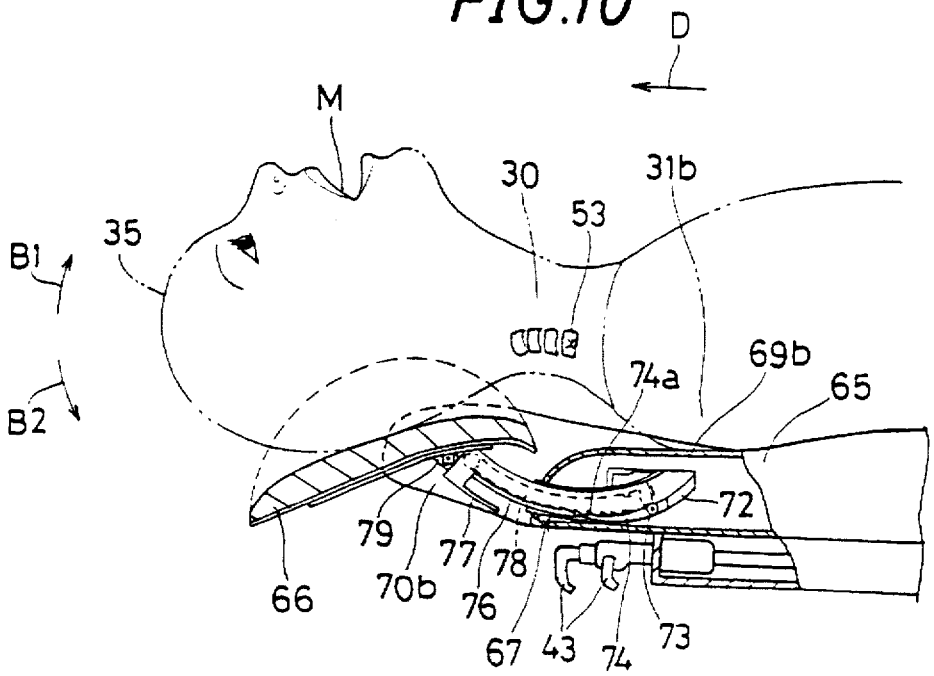
FIG. 10 is a section view showing a state in which a headrest 66 is angularly displaced from the state shown in FIG. 9.

FIG. 9 is a section view specifically showing the concrete configuration of the engaging means 67, and FIG. 10 is a section view showing a state in which the headrest 66 is angularly displaced from the state shown in FIG. 9. The engaging means 67 comprises: a guide pipe 72 fixed to the backrest 65; an engaging claw 74 which is pivotally supported by the guide pipe 72 and which has a front end portion 74*a* biased by a torsion spring 73 in a clockwise direction in FIG. 9; an arcuate and hollow support arm 76 in which a plurality of engaging grooves 75 into which the front end portion 74*a* of the engaging claw 74 is to be fitted are formed, and the vicinity of one end portion in the axial direction along which the engaging grooves 75 are formed is inserted into the guide pipe 72 to be supported thereby; an operation lever 77 which is pivotally disposed in the other end portion of the support arm 76 in the axial direction; and an arcuate lock releasing member 78 which is caused to be tilted in the support arm 76 by angular-displacement of the operation lever 77, so as to push the front end portion 74*a* of the engaging claw 74 which engages with one of the engaging grooves 75, in a radially outward direction, thereby canceling the engaging state between the engaging claw 74 and the engaging groove 75.

The other end portion of the support arm 76 in the axial direction is fixed to a bracket 79 secured to the lower face of the headrest 66, by, for example, welding. The support arm 76 is inserted into the guide pipe 72, and fixedly engaged by fitting the front end portion 74*a* of the engaging claw 74 into one of the engaging grooves 75. When the lever 77 is pulled in this state in the direction of the arrow F, the lock releasing member 78 pushes the engaging claw 74 so that the front end portion 74*a* of the engaging claw 74 retracts from the engaging groove 75, thereby allowing the support arm 76 to be displaced along the guide pipe 72. In accordance with the displacement, the headrest 66 is angularly displaced about the center of the curvature of the guide pipe 72. In the state where the support arm 76 is displaced and the headrest 66 is located at a desired position, the front end portion 74*a* of the engaging claw 74 is fitted into one of the engaging grooves 75, with the result that the headrest 66 can be supported while being located at the desired position.

In the same manner as the embodiment shown in FIGS. 1 to 5, by means of the engaging means 67, the head 35 of the patient 2 can be tilted in the direction of the arrow B2 by operating the operation lever 77 under the state shown in FIG. 9 so as to change the engaging groove 75 into which the front end portion 74*a* of the engaging claw 74 is to be fitted, to another one. The intervals of the engaging grooves 75 correspond to the angular-displacement angle of the headrest 68. Therefore, the angular-displacement position of the headrest 68 can be arbitrarily determined by selecting the engaging groove 75 into which the front end portion 74*a* of the engaging claw 74 is to be fitted.

In the dental treatment table 1*a*, when the patient 2 lies face upward on the treating bed 61 with fitting the shoulders 31*a* and 31*b* into the recesses 69*a* and 69*b* of the backrest 65 and the head 35 is supported on the headrest 68, the seventh vertebrae cervicale 53 of the patient 2 is located at the center of the curvature of the guide pipe 72. According to this configuration, when the head 35 of the patient 2 is tilted in the direction of the arrow B2 by displacing the headrest 66, the head 35 of the patient 2 is angularly displaced or moved about the seventh vertebrae cervicale 53 of the patient, and hence no burden is imposed on the neck 30 of the patient. Even when the head 35 is tilted in this way, therefore, sensation of uneasiness is not felt by the patient 2. Furthermore, the shoulders 31*a* and 31*b* of the patient 2 are supported by being fitted into the recesses 69*a* and 69*b*, and hence the patient 2 is prevented from being displaced toward the head 35 as indicated by the arrow D. Therefore, the position of the mouth M of the patient 2 is not largely moved by displacing the headrest 66 so as to tilt the head 35, with the result that the operator can smoothly perform the treatment.

Figure 11:
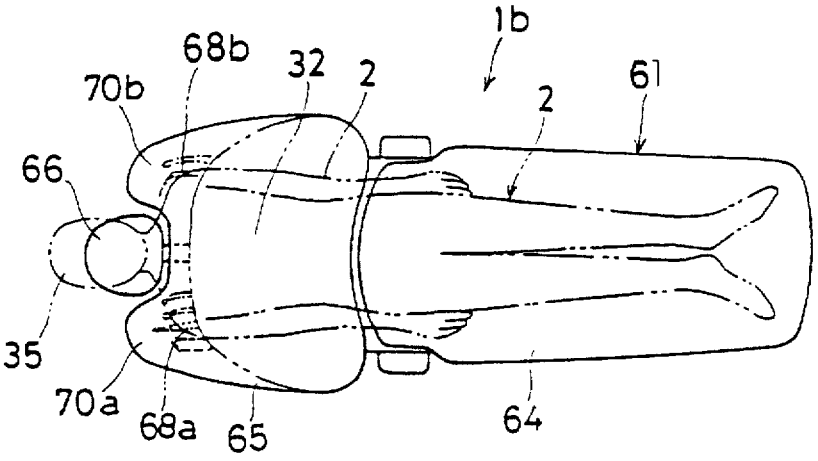
FIG. 11 is a plan view showing a dental treatment table 1*b* which is a further embodiment of the invention.
Figure 12:
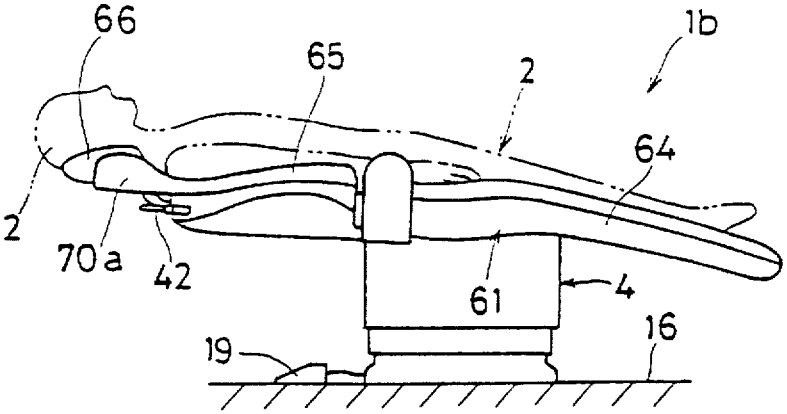
FIG. 12 is a side view of the dental treatment table 1*b;*
Figure 13:
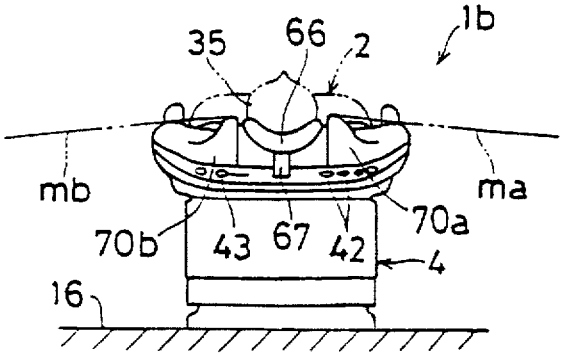
FIG. 13 is a front view of the dental treatment table 1*b*.

FIG. 11 is a plan view showing a dental treatment table 1*b* which is a further embodiment of the invention, FIG. 12 is a side view of the dental treatment table 1*b* shown in FIG. 11, and FIG. 13 is a front view of the dental treatment table 1*b* as seen from the left side in FIG. 12. The dental treatment table 1*b* of the embodiment is similar to the dental treatment table 1*a* shown in FIGS. 6 to 10. The corresponding portions are designated by the same reference numerals, and their description is omitted.

Attention must be directed to the followings. The configuration described above is modified so that the stretched portions 70*a* and 70*b* elongate from the shoulder supporting portions 68*a* and 68*b* where the recesses 69*a* and 69*b* are formed, toward the sides of the headrest 68, and are smoothly upwardly raised as moving from the shoulder supporting portions 68*a* and 68*b* toward the side potions 80*a* and 80*b* of the headrest 68. The stretched portions 70*a* and 70*b* can smoothly guide the hair of the patient 2 toward the sides and the back 32 of the patient 2 and hold the hair. Furthermore, the visual ranges which are lower than the phantom lines ma and mb shown in FIG. 13 are blocked. Even when the head 35 of the patient 2 is tilted rightward or leftward, therefore, the operation of the instruments 42 and 43 is out of sight of the patient 2, and hence the operator can perform the treatment without producing sensations of fear and uneasiness in the patient 2. In the same manner as the dental treatment table 1*a* shown in FIGS. 6 to 10, in the dental treatment table 1*b*, treatment can be smoothly performed without producing sensations of fear and oppression in the patient 2.

The invention is not restricted to the dental treating tables 1, 1*a*, and 1*b*, and may be suitably applied to a treatment table for otorhinology and that for ophthalmology with attaining the same configuration.

In the configuration described above, the operator instruments 42 and the assistance instruments 43 are disposed in the bed body 13. In a further embodiment of the invention, the table may comprise various operation switches such as a switch for adjusting the amount of air or water ejected from the 3-way syringe, a display unit which displays the amount of ejected air or water, and the like. The further embodiment may be configured so that the instruments are detachably hung on the backrest or a tray table disposed on the backrest. Also in the configuration, treatment can be smoothly performed without causing the patient to see the various operation switches, the display unit, and operations conducted by the operator.

Alternatively, a transparent portion made of a transparent material may be partially formed in the stretched portions 10*a* and 10*b* or 70*a* and 70*b* in a range including the line of sight attained when the operator sitting on the treatment chair 23 looks in the direction toward the place where the operator instruments 42 exist. In the alternative, it is easy for the operator to visually recognize the operator instruments 42 in the state where the patient cannot see the instruments, thereby allowing the operator to smoothly perform treatment.

Figure 14:
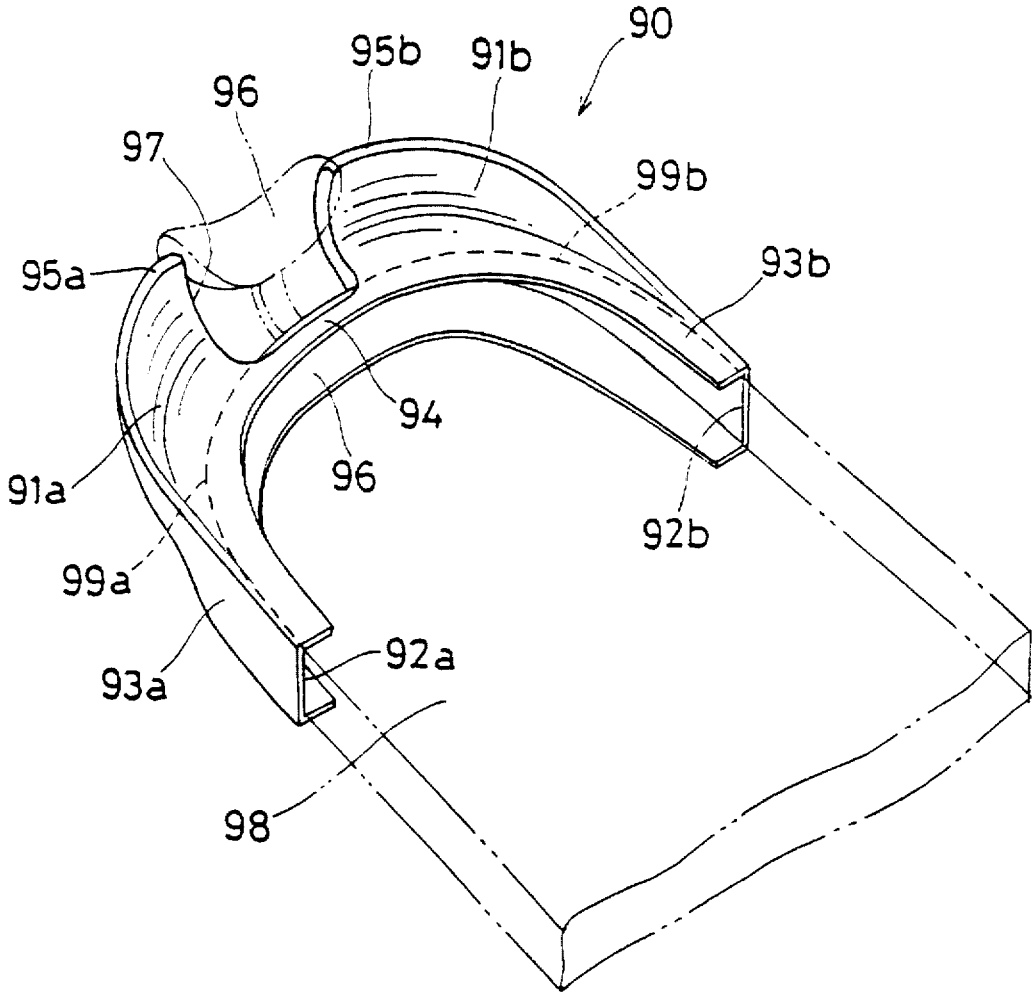
FIG. 14 is a perspective view showing a stretched portion unit 90.

FIG. 14 is a perspective view showing a stretched portion unit 90. The stretched portion unit 90 has a substantially U-like shape, and comprises stretched portions 91*a* and 91*b* which are symmetrically formed and connected to each other. The stretched portions 91*a* and 91*b* comprise base portions 93*a* and 93*b* in which fitting grooves 92*a* and 92*b* are formed so as to oppose each other, and raised portions 95*a* and 95*b* which are upwardly raised as approaching a connecting portion 94 where the base portions 93*a* and 93*b* are connected to each other. In the connecting portion 94, a fitting groove 96 which communicates with the fitting grooves 92*a* and 92*b* is formed. Between the stretched portions 91*a* and 91*b*, formed is a recess 97 in which, when the stretched portion unit 90 is attached to a backrest 98, a headrest 96 is placed.

The thus configured stretched portion unit 90 may be detachably mounted to an existing dental treatment table, in such a manner that shoulder portions 99*a* and 99*b* of the backrest 98 are fitted into the fitting grooves 92*a* and 92*b*. When the stretched portion unit 90 is attached to the treatment table, the stretched portions 91*a* and 91*b* can be integrally formed on the treatment table. Also in the case where he stretched portion unit 90 is used, the same effects as those of the above-described embodiments can be attained.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which came within the meaning and the range of equivalency of the claims are therefore intended to be embraced therein.

What is claimed is:

1. A medical treatment table comprising:

a backrest for supporting a back of a patient; and a headrest for supporting a head of the patient, the backrest being provided with a pair of shoulder supporting portions for supporting both shoulders of the patient, the headrest being disposed on the backrest so as to be tiltable with respect to the backrest, wherein a pair of stretched portions each of which elongates obliquely upwardly toward each side of the headrest are integrally formed with the pair of shoulder supporting portions, between the pair of stretched portions is formed a recess, in which the headrest is disposed so as to be tiltable, and the pair of stretched portions separate a patient's space in which the head of the patient is placed, from an operator's space in which medical instruments are placed.

2. The medical treatment table of claim 1, wherein the pair of stretched portions are respectively formed so as to include a substantially triangle area which is formed by connecting a point of each side of the headrest, a vertically below point of each side of the patient's neck and an intersection point of a line extending through a vertically below point of each shoulder of the patient to each side of the backrest, and said side of the backrest.

3. The medical treatment table of claim 1, wherein the headrest is supported on the pair of stretched portions so as to be tiltable about a horizontal axis.

4. The medical treatment table of claim 3, wherein the horizontal axis for supporting the headrest is located at an upper position than the upper face of the backrest, and a contact portion of the headrest with which the head of the patient makes contact is located lower than the horizontal axis.

* * * * *

UNITED STATES PATENT AND TRADEMARK OFFICE

CERTIFICATE OF CORRECTION

PATENT NO. : 5,730,497

DATED : March 24, 1998

INVENTOR(S) : Daryl Raymond Beach, et al.

It is certified that error appears in the above-indentified patent and that said Letters Patent is hereby corrected as shown below:

Title page, item [19] should read -- Beach,et al --

Item [75] Inventors: Change "Daryl Beach Raymond, Osaka; Masato Miyahara, Kyoto, both of Japan" to --Daryl Raymond Beach, Osaka; Masato Miyahara, Kyoto, both of Japan--

Signed and Sealed this

Twenty-first Day of July, 1998

Bruce Lehman

*Attest:*

BRUCE LEHMAN

*Attesting Officer*

*Commissioner of Patents and Trademarks*